US009084448B2

(12) United States Patent
Keum

(10) Patent No.: US 9,084,448 B2
(45) Date of Patent: Jul. 21, 2015

(54) CLIP-SHAPED DEVICE FOR PREVENTING TOPS FROM BECOMING UNTUCKED

(71) Applicant: Gyu Te Keum, Cheongju-si (KR)

(72) Inventor: Gyu Te Keum, Cheongju-si (KR)

( * ) Notice: Subject to any disclaimer, the term of this patent is extended or adjusted under 35 U.S.C. 154(b) by 0 days.

(21) Appl. No.: 14/007,384

(22) PCT Filed: Nov. 8, 2012

(86) PCT No.: PCT/KR2012/009380

§ 371 (c)(1),
(2) Date: Sep. 25, 2013

(87) PCT Pub. No.: WO2013/081312

PCT Pub. Date: Jun. 6, 2013

(65) Prior Publication Data

US 2014/0250634 A1 Sep. 11, 2014

(30) Foreign Application Priority Data

Nov. 30, 2011 (KR) ..... 10-2011-0127205

(51) Int. Cl.
*A41F 5/00* (2006.01)
*A41F 17/02* (2006.01)
*A41F 17/00* (2006.01)

(52) U.S. Cl.
CPC . *A41F 17/02* (2013.01); *A41F 5/00* (2013.01); *A41F 17/00* (2013.01); *Y10T 24/1394* (2015.01); *Y10T 24/3428* (2015.01)

(58) Field of Classification Search
CPC ..... A41F 17/00; A41F 17/02
USPC ..... 24/3.12, 3.28, 498, 515, 516, 535, 536, 24/539, 327; 2/303, 304, 323, 324, 335, 2/337, 340, 117
See application file for complete search history.

(56) References Cited

U.S. PATENT DOCUMENTS

| | | | | |
|---|---|---|---|---|
| 668,088 | A * | 2/1901 | Bruce | 24/3.12 |
| 685,983 | A * | 11/1901 | Gutmann | 24/516 |
| 821,466 | A * | 5/1906 | Croasdale | 24/516 |
| 830,759 | A * | 9/1906 | Andresen | 24/516 |
| 903,373 | A * | 11/1908 | Hall | 24/499 |
| 1,272,079 | A * | 7/1918 | Norman | 24/496 |
| 2,214,524 | A * | 9/1940 | Deming | 24/516 |
| 5,177,813 | A * | 1/1993 | Bosack et al. | 2/323 |
| 5,313,669 | A * | 5/1994 | Rasdell et al. | 2/323 |
| 2007/0192998 | A1 * | 8/2007 | Ryder | 24/1 |
| 2010/0031476 | A1 * | 2/2010 | Coldiron | 24/3.12 |
| 2012/0047697 | A1 * | 3/2012 | Vargas Cervantes et al. | 24/489 |

* cited by examiner

*Primary Examiner* — Robert J Sandy
*Assistant Examiner* — Louis Mercado
(74) *Attorney, Agent, or Firm* — LRK Patent Law Firm

(57) ABSTRACT

A clip-shaped device for preventing tops from becoming untucked, where pants are fixed between an upper clip part and a lower clip part and a belt is fixed between the upper clip part and a decorative cover element, and at the same time, lower ends of the tops are fixed by a fixing member, thereby preventing the lower ends of the tops from being exposed to the outside of the bottoms. Since a tops fixing member, the clip member, and the decorative cover element are included, the tops fixing member fixes the lower ends of the tops, the clip member fixes the pants, and the belt is fixed between the decorative cover element and the clip member such that the lower ends of the tops are not exposed to the outside of the bottoms, and thus clothes can be worn neatly and comfortably.

7 Claims, 7 Drawing Sheets

CLIP-SHAPED DEVICE FOR PREVENTING TOPS FROM BECOMING UNTUCKED

TECHNICAL FIELD

The present invention relates to a clip-shaped device for preventing tops from becoming untucked, especially to a clip-shaped device for preventing tops from becoming untucked which fixes user's bottoms between an upper clip part and a lower clip part as well as a belt between the upper clip part and a decorative cover element, while at the same time fixing lower ends of the tops using a fixing member, so that the lower ends of the tops are prevented from being exposed to the outside of the bottoms.

BACKGROUND ART

Most of men and women wear Y-shirts or blouses matching with suits, that is, dress shirt-type tops.

The Y-shirts or blouses are neat and has an atmosphere of refinement when being worn with suits, and therefore white-collar workers often wear the Y-shirts or blouses.

However, when a user repeatedly stands up and sits down after wearing the dress shirt or blouse, the left and right waist parts of the Y-shirt naturally come loose out of the user's bottoms to the outside of a belt line. In order to solve this, there is provided a prior art in which the inside of user's bottoms or skirt is treated with silicon tapes, however, the left and right waist parts of the Y-shirts eventually come loose out of the user's bottoms or skirts while the user moves, which causes the user to often tuck the tops into the user's bottoms or skirts.

To solve the above-mentioned defect, a preventing hole for preventing tops from being untucked is disclosed in Publication NO. 1020080039365 in which a dress shirt or a T-shirt is fixed using gravity of the preventing hole, so that an end of the dress shirt or T-shirt is prevented from coming loose out of user's bottom to the outside of a belt line.

However, according to the above-mentioned prior art, the user has substantially-limited movements because a number of weight bodies are fixed on the user's tops, and the weight bodies have to be heavy because gravity is used.

Accordingly, there is still a problem that the tops may come loose out of the user's bottoms when light weight bodies are fixed.

DISCLOSURE

Technical Problem

Accordingly, in order to solve the above-mentioned problems, an object of the present invention is to provide a clip-shaped device for preventing tops from becoming untucked which is configured to include a tops fixing member, a clip member, and a decorative cover element, wherein the tops fixing member is fixed on lower ends of the tops, the clip member fixes user's bottoms, and a belt is fixed between the decorative cover element and the clip member, so that the lower ends of the tops are prevented from being exposed to the outside of the user's bottoms.

Another object of the present invention is to provide a clip-shaped device for preventing tops from becoming untucked in which an angle between a patterned part and a bending part is formed in the range of 90 to 100 degrees, and, when a user presses the patterned part after inserting a belt between the patterned part and an upper clip part, the bending part is in contact with the upper surface of a lower clip part and is moved upwards, so that the user's bottoms inserted between the upper clip part and the lower clip part is fixed, while at the same time the belt inserted between the upper clip part and the decorative cover element is fixed.

Another object of the present invention is to provide a clip-shaped device for preventing tops from becoming untucked which forms a patterned part carved with patterns in a decorative cover element, so that the device not only has a function to prevent tops from becoming untucked, but also is used as an ornament.

Technical Solution

According to one embodiment of the present invention, these objects are achieved by a clip-shaped device for preventing tops from becoming untucked which is configured to include a tops fixing member 100, a clip member 200, and a decorative cover element 300, wherein the tops fixing member consists of a tops fixing part 110 which adheres to tops 10 and prevents the tops from becoming untucked, and an elastic part 120 which has any one side adhering to the tops fixing part and another side adhering to a lower clip as well as is made out of an elastic material that is deformable to adhere to a human body, the clip member consists of a lower clip part 210 which has a pair of support pieces 212 that respectively form clip holes into which clip protrusion parts formed on an upper clip part are inserted inside and has an end formed to be bent, and an upper clip part 220 which has the clip protrusion parts 221 formed in a bent manner to be inserted into the clip holes, forms hinge holes for the cover element into which hinge protrusions formed on the decorative cover element are inserted on the left and right sides of one end of the upper clip part, and has another end formed to be bent, and the decorative cover element consists of hinge protrusions 310 which are formed on the left and right sides of the decorative cover element to be inserted into the hinge holes for the cover element of the upper clip part, a patterned part 330 which has patterns carved thereon, and a bending part 320 which is connected to the patterned part and is formed to be bent.

Advantageous Effects

According to the present invention, a clip-shaped device for preventing tops from becoming untucked with such configuration and effect is configured to include a tops fixing member, a clip member, and a decorative cover element, wherein the tops fixing member is fixed on lower ends of the tops, the clip member fixes user's bottoms, and a belt is fixed between the decorative cover element and the clip member, so that the lower ends of the tops are prevented from being exposed to the outside of the user's bottoms, and therefore the present invention achieves the effect that the user can have a neat style of dressing and comfortably wear clothes.

In addition, an angle between a patterned part and a bending part is formed in the range of 90 to 100 degrees, and, when a user presses the patterned part after inserting a belt between the patterned part and an upper clip part, the bending part is in contact with the upper side of a lower clip part and is moved upwards, so that the user's bottoms inserted between the upper clip part and the lower clip part is fixed, while at the same time the belt inserted between the upper clip part and the decorative cover element is fixed, and therefore the present invention achieves the effect of fixing tops by a single touch.

Moreover, a patterned part carved with patterns is formed in a decorative cover element, so that the present invention achieves the effect that the device not only has a function to Prevent tops from becoming untucked, but also is used as an ornament when the decorative cover element to be exposed is designed in a luxurious manner, and therefore a new clothing culture can be created.

BEST MODE

Figure 1:
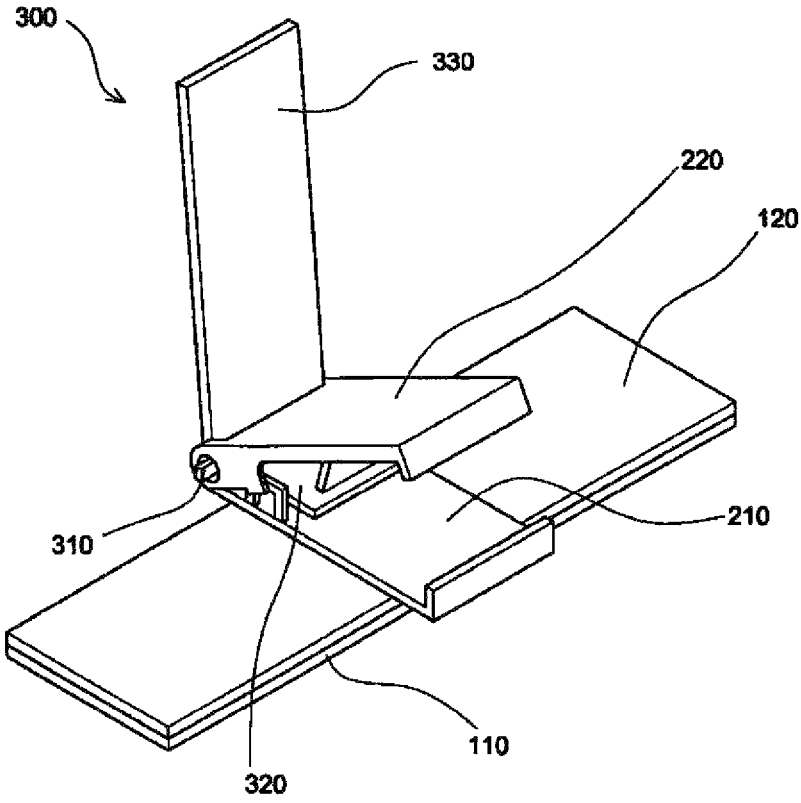
FIG. 1 illustrates a clip-shaped device for preventing tops from becoming untucked according to one embodiment of the present invention in a perspective view.

To achieve the above-mentioned objects, it is characterized in that a clip-shaped device for preventing tops from becoming untucked according to one embodiment of the present invention is configured to include a tops fixing member 100, a clip member 200, and a decorative cover element 300, wherein the tops fixing member consists of a tops fixing part 110 which adheres to tops 10 and prevents the tops from becoming untucked, and an elastic part 120 which has any one side adhering to the tops fixing part and another side adhering to a lower clip as well as is made out of an elastic material that is deformable to adhere to a human body, the clip member consists of a lower clip part 210 which has a pair of support pieces 212 that respectively form clip holes into which clip protrusion parts formed on an upper clip part are inserted inside and has an end formed to be bent, and an upper clip part 220 which has the clip protrusion parts 221 formed in a bent manner to be inserted into the clip holes, forms hinge holes for the cover element into which hinge protrusions formed on the decorative cover element are inserted on the left and right sides of one end of the upper clip part, and has another end formed to be bent, and the decorative cover element consists of hinge protrusions 310 which are formed on the left and right sides of the decorative cover element to be inserted into the hinge holes for the cover element of the upper clip part, a patterned part 330 which has patterns carved thereon, and a bending part 320 which is connected to the patterned part and is formed to be bent.

Herein, it is characterized in that two or more the clip members to which the decorative cover elements are coupled are mounted on the tops fixing member. Herein, it is also characterized in that a part of user's bottoms 20 is inserted between the lower clip part 210 and the upper clip part 220. Herein, it is also characterized in that the decorative cover element 300 has a shape of '¬' and a belt 30 is inserted into the decorative cover element. Herein, it is also characterized in that angle A between the patterned part 330 and the bending part 320 of the decorative cover element 300 is formed in the range of 90 to 100 degrees, and, when a user presses the patterned part after inserting the belt 30 between the patterned part and an upper clip part, the bending part is in contact with the upper side of the lower clip part and is moved upwards, so that the user's bottoms inserted between the upper clip part and the lower clip part is fixed, while at the same time the belt 30 inserted between the upper clip part and the decorative cover element is fixed.

Figure 2:
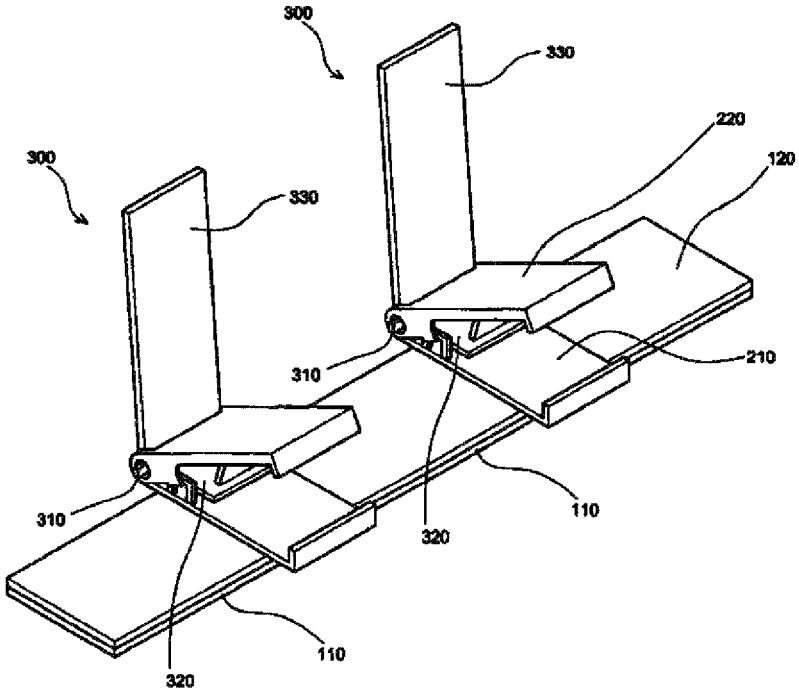
FIG. 2 illustrates a clip-shaped device for preventing tops from becoming untucked according to another embodiment of the present invention in a perspective view.
Figure 3:
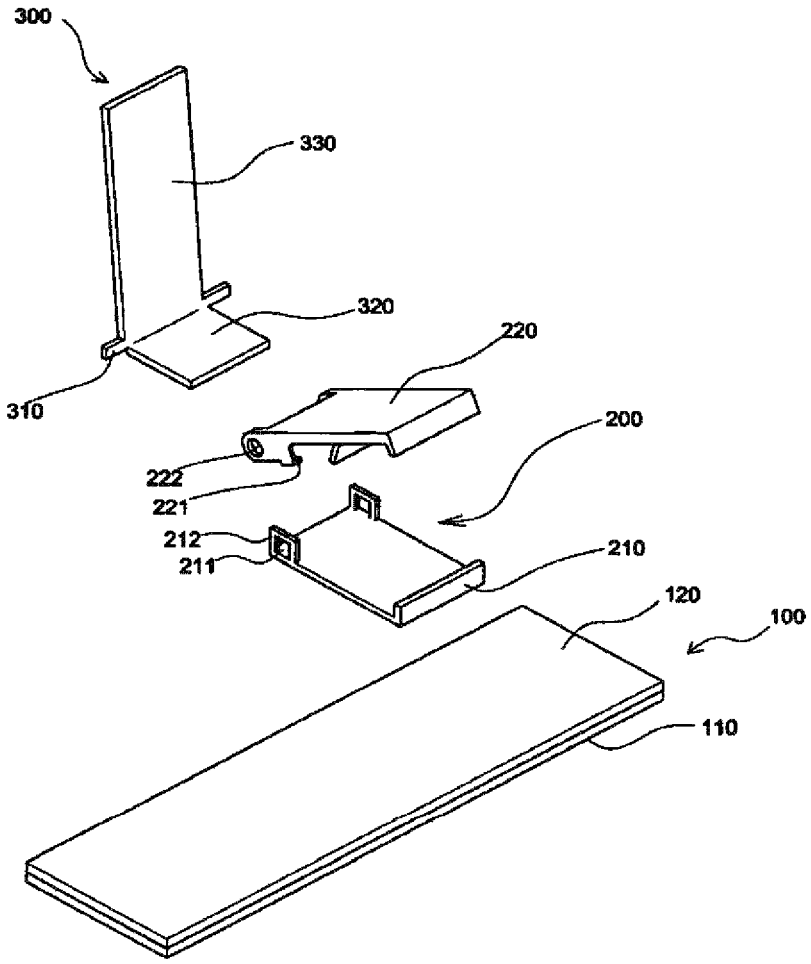
FIG. 3 illustrates the clip-shaped device for preventing tops from becoming untucked according to one embodiment of the present invention in an exploded perspective view.
Figure 4:
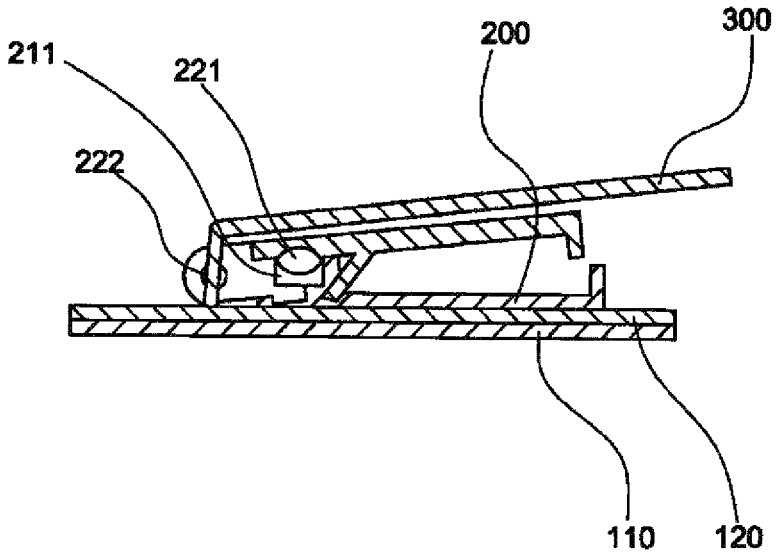
FIG. 4 illustrates the clip-shaped device for preventing tops from becoming untucked according to one embodiment of the present invention in a cross-sectional view.

In addition, it is characterized in that one or more clip-shaped device for preventing tops from becoming untucked according to the present invention is mounted on lower ends of the tops. Herein, it is characterized in that the tops fixing part 110 is made out of a rubber material. Hereinafter, embodiments of a clip-shaped device for preventing tops from becoming untucked according to the present invention are described in detail. FIG. 1 illustrates a clip-shaped device for preventing tops from becoming untucked according to one embodiment of the present invention in a perspective view. FIG. 2 illustrates a clip-shaped device for preventing tops from becoming untucked according to another embodiment of the present invention in a perspective view. FIG. 3 illustrates the clip-shaped device for preventing tops from becoming untucked according to one embodiment of the present invention in an exploded perspective view. FIG. 4 illustrates the clip-shaped device for preventing tops from becoming untucked according to one embodiment of the present invention in a cross-sectional view.

As shown in FIGS. 1 through 4, the clip-shaped device for Preventing tops from becoming untucked according to the present invention is configured to include a tops fixing member 100, a clip member 200, and a decorative cover element 300, wherein the tops fixing member consists of a tops fixing part 110 which adheres to tops 10 and prevents the tops from becoming untucked, and an elastic part 120 which has any one side adhering to the tops fixing part and another side adhering to a lower clip as well as is made out of an elastic material that is deformable to adhere to a human body, the clip member consists of a lower clip part 210 which has a pair of support pieces 212 that respectively form clip holes into which clip protrusion parts formed on an upper clip part are inserted inside and has an end formed to be bent, and an upper clip part 220 which has the clip protrusion parts 221 formed in a bent manner to be inserted into the clip holes, forms hinge holes for the cover element into which hinge protrusions formed on the decorative cover element are inserted on the left and right sides of one end of the upper clip part, and has another end formed to be bent, and the decorative cover element consists of hinge protrusions 310 which are formed on the left and right sides of the decorative cover element to be inserted into the hinge holes for the cover element of the upper clip part, a patterned part 330 which has patterns carved thereon, and a bending part 320 which is connected to the patterned part and is formed to be bent.

The tops fixing member 100 is configured to include the tops fixing part 110 which adheres to the tops 10 and prevents the tops from becoming untucked, and the elastic part 120 which has any one side adhering to the tops fixing part and another side adhering to the lower clip as well as is made out of an elastic material that is deformable to adhere to a human body.

Herein, it is characterized in that the tops fixing member 110 adheres to tops and is made out of a rubber material that prevents slipping to prevent the tops from becoming untucked.

Specifically, the tops fixing member is made out of a rubber material with high adhesion strength, thereby preventing tops from coming loose upwards, while at the same time having an effect of preventing pressure from being applied to the waist in contact therewith.

In addition, the elastic part 120 has any one side adhering to the tops fixing part and another side adhering to the lower clip, and is made out of an elastic material that is deformable according to the curve of a human body. Herein, it is preferable that although either of an adhesive and a rivet is used as a coupling means, the present invention is not limited to any coupling means besides the examples.

If the fixing member is configured as described above, then lower ends of the tops can be fixed, and therefore the lower ends of the tops are prevented from being exposed to the outside of user's bottoms.

Besides, the clip member 200 is configured to include the lower clip part 210 which has a pair of the support pieces 212 that respectively form the clip holes into which the clip protrusion parts formed on the upper clip part are inserted inside and has an end formed to be bent, and the upper clip part 220 which has the clip protrusion parts 221 formed in a bent manner to be inserted into the clip holes, forms the hinge holes for the cover element into which the hinge protrusions formed on the decorative cover element are inserted on the left and right sides of one end of the upper clip part, and has another end formed to be bent.

Specifically, on the left and right sides of the lower clip part 210, a pair of the support pieces 212, which has the clip holes 211 into which the clip protrusion parts formed on the left and right sides of the upper clip are inserted, respectively, is formed.

And an end of the lower clip is formed to be bent.

In addition, the upper clip part 220 has the clip protrusion parts 221 which are formed in an inwardly-bent manner to be inserted into the clip holes formed on the left and right sides, forms the hinge holes for the cover element 222 into which the hinge protrusions formed on the decorative cover element are inserted at one end, and has another end formed to be bent.

Herein, bent portions of the lower and upper clip parts are in contact with user's bottoms 20, so that the clip-shaped device for preventing tops from becoming untucked is fixed on the bottoms 20.

Besides, the decorative cover element 300 is configured to include the hinge protrusions 310 which are formed on the left and right sides of the decorative cover element to be inserted into the hinge holes for the cover element of the upper clip part, the patterned part 330 which forms patterns carved thereon, and the bending part 320 which is connected to the patterned part and is formed to be bent.

Specifically, the hinge protrusions 310 are formed on the left and right sides of the bending part 320 to be inserted into the hinge holes for the cover element of the upper clip part.

Also, the decorative cover element has the bending part connected to the patterned part in a bent manner, thereby having a shape of '¬l'.

A variety of patterns are carved on an external surface of the patterned part, and if the patterned part is pressed, an end of the bending part is in contact with the lower clip part.

In addition, the patterned part has ornament patterns, e.g., flower patterns, various design patterns, etc., formed thereon, thereby being used as an ornament, and therefore a new clothing culture can be created.

Besides, as shown in FIG. 2, two or more clip members to which the decorative cover elements are coupled may be mounted on the tops fixing member 100.

Specifically, two or more clip members to which the decorative cover elements are coupled are mounted on the tops fixing member in a determined distance, and this prevents tops from becoming untucked easier than the case in which only one clip member is used.

For example, when the tops fixing member with two or more clip members is made to be longer than that with one clip member, a function for preventing tops from becoming untucked is stronger, and the tops fixing member may be tilted or come out of the user's bottoms 20 when only one clip is used, and therefore a plurality of clip members to which decorative cover elements are coupled are mounted on a tops fixing member which is longer than that with only one clip member in a determined distance.

Although the example of the present invention includes the case in which two clip members to which decorative cover elements are coupled are mounted on a tops fixing member, the number of the clip members to be configured may be more than two, e.g., three, four, etc.

Figure 5:
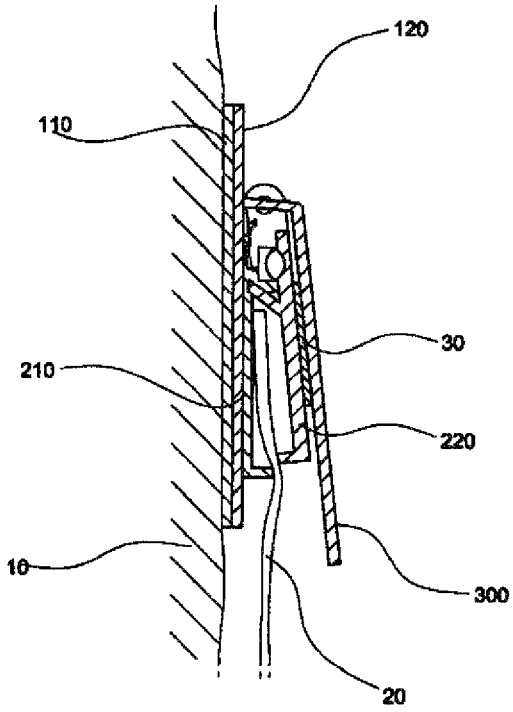
FIG. 5 illustrates an example in which the clip-shaped device for preventing tops from becoming untucked according to one embodiment of the present invention adheres to clothes in a side view.

FIG. 5 illustrates an example in which the clip-shaped device for preventing tops from becoming untucked according to one embodiment of the present invention adheres to clothes in a side view.

Figure 6:
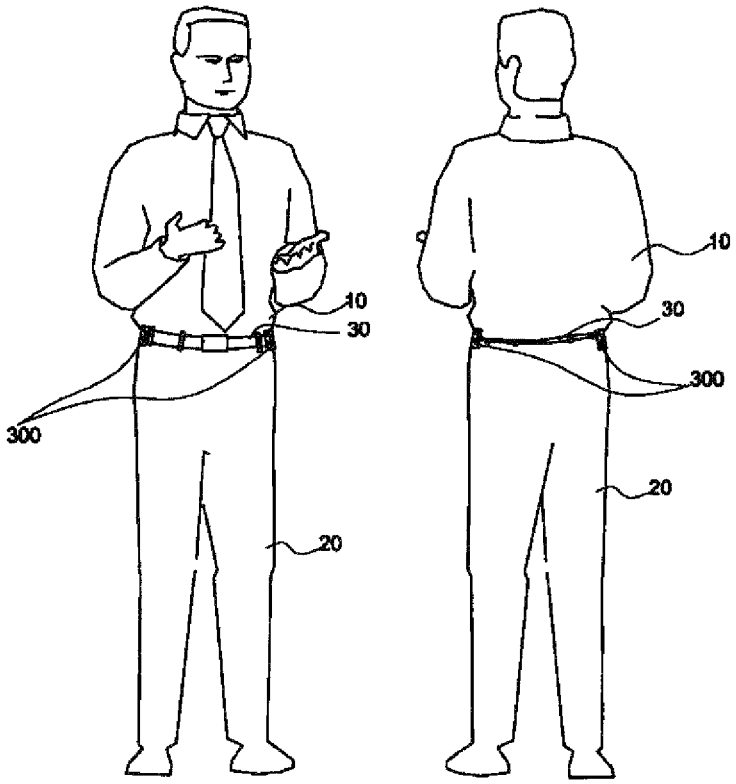
FIG. 6 illustrates an example in which a decorative cover element is coupled to the clip-shaped device for preventing tops from becoming untucked according to one embodiment of the present invention and then the device adheres to clothes in an exemplary view.

FIG. 6 illustrates an example in which a decorative cover element is coupled to the clip-shaped device for preventing tops from becoming untucked according to one embodiment of the present invention and then the device adheres to clothes in an exemplary view.

As shown in FIG. 5, after a user tucks tops in his or her bottoms, when the user places an elastic part of a tops fixing member on the waist, fixes the waist part of his or her bottoms 20 into a clip member, inserts a belt between a patterned part and an upper clip part, and presses the patterned part, a bending part is in contact with an upper surface of a lower clip part and is moved upwards, that is, toward the user's body, so that the user's bottoms 20 inserted between the upper clip part and the lower clip part is fixed, while at the same time the belt 30 inserted between the upper clip part and a decorative cover element is fixed.

That is, an effect of one touch-type fixing clip is provided. However, conversely, when the user pulls the patterned part of the decorative cover element, the belt 30 and the patterned part are distanced from each other, and, when the user continuously pulls the patterned part, the clip member is opened and the upper clip part of the clip member are distanced from the bottoms 20, and then eventually the bottoms 20 can come out of the clip-shaped device for preventing tops from becoming untucked.

Also, the decorative cover element is formed in such a manner that various patterns are made on a quadrangular, pentagonal, circular, diamond-shaped, or triangular member.

Figure 7:
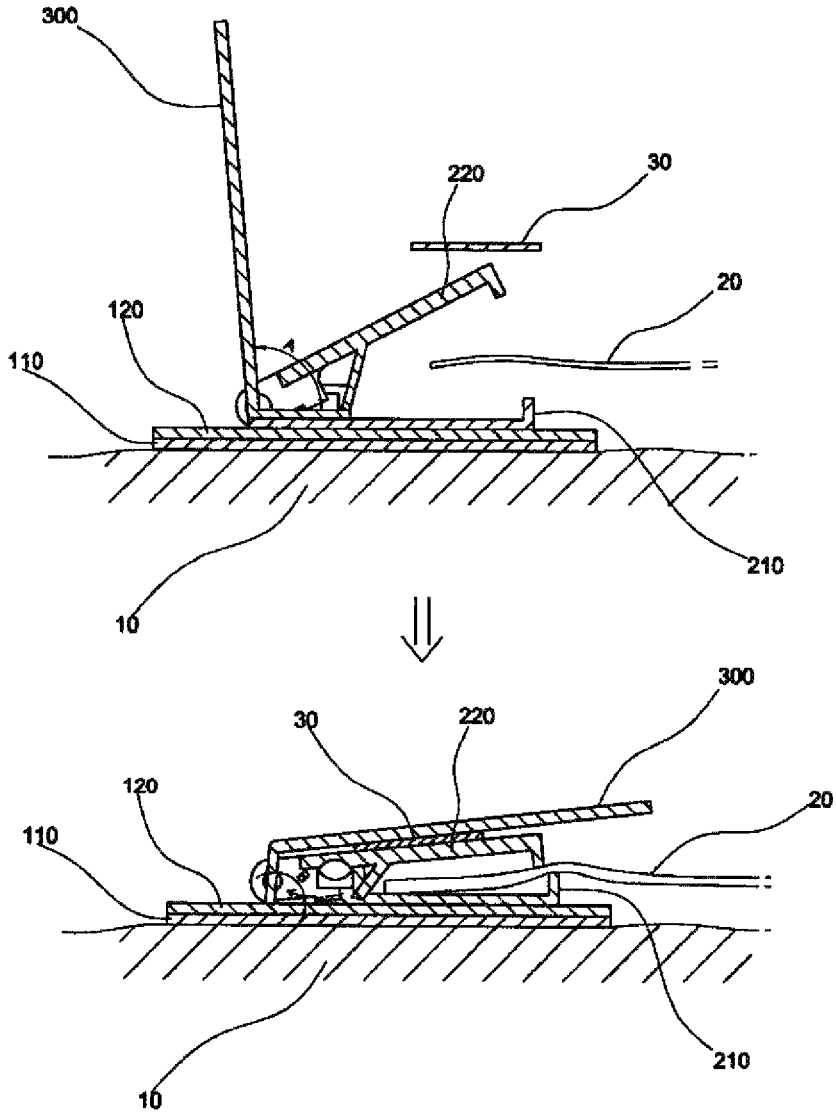
FIG. 7 illustrates an angle between a bending part and a lower clip part formed when the decorative cover element of the clip-shaped device for preventing tops from becoming untucked according to one embodiment of the present invention is pressed or pulled in an exemplary view.

Angle A between the patterned part 330 and the bending part 320 is formed in the range of 90 to 100 degrees, and when the patterned part is continuously pressed towards the upper clip part, an end of the bending part is moved upwards, that is, toward the user's body, and angle B smaller than 90 degrees is formed, as shown in FIG. 7, and therefore the bottoms 20 and the belt 30 are not exposed to the outside of the clip-shaped device for preventing tops from becoming untucked before the user manually pulls the decorative cover element.

In addition, when a spring or an elastic member is inserted between the lower clip part 210 and the upper clip part and the decorative cover element is pulled, the space between the upper clip part and the lower clip part is widen by the action of the spring of elastic member, and therefore the clip member can easily come out of the bottoms 20.

Furthermore, fixing devices are mounted on the left and right sides of the waist, respectively, and two or more devices are fixed if necessary, thereby preventing tops from coming out of user's bottoms.

FIG. 6 illustrates an example in which the clip-shaped device for preventing tops from becoming untucked with two clip members according to another embodiment of the present invention can be fixed on tops and another example in which the clip-shaped device for preventing tops from becoming untucked with two clip members according to one embodiment of the present invention can be fixed on tops.

Especially, the device has a function to prevent tops from coming sideways out of user's bottoms.

A clip-shaped device for preventing tops from becoming untucked with such a configuration and operation is configured to include a tops fixing member, a clip member, and a decorative cover element, wherein the tops fixing member is fixed on lower ends of the tops, the clip member fixes user's bottoms, and a belt is fixed between the decorative cover element and the clip member, so that the lower ends of the tops are prevented from being exposed to the outside of the user's bottoms, and therefore the present invention achieves the effect that the user can have a neat style of dressing and comfortably wear clothes.

In addition, an angle between a patterned part and a bending part is formed in the range of 90 to 100 degrees, and, when a user presses the patterned part after inserting a belt 30 between the patterned part and an upper clip part, the bending part is in contact with the upper surface of a lower clip part and is moved upwards, so that the user's bottoms inserted between the upper clip part and the lower clip part is fixed, while at the same time the belt inserted between the upper clip part and the decorative cover element is fixed, and therefore the present invention achieves the effect of fixing tops by a single touch.

It is understood by those skilled in the art in the technical field of the present invention that the present invention can be carried out in other specific forms without modifications of the technical ideas or essential characteristics of the present invention. Therefore, it is understood that the embodiments described above are, not to be taken in a limiting sense, exemplary in all respects.

It is understood that the scope of the present invention is represented by the claims which will be described later rather than by the above detailed description, and the meaning and scope of the claims as well as any modifications or variations derived from the equivalent concept of the claims are included in the scope of the present invention.

The invention claimed is:

1. A clip-shaped device for preventing tops from becoming untucked, comprising:

a tops fixing member;

a clip member; and a decorative cover element, wherein the tops fixing member includes a tops fixing part which adheres to a top and prevents the tops from becoming untucked, and an elastic part which has one side adhering to the tops fixing part as well as another side adhering to a lower clip and is made out of an elastic material that is deformable to adhere to a human body, wherein the clip member includes a lower clip part which has a pair of support pieces with clip holes, and an upper clip part which has clip protrusion parts formed in a bent manner to be inserted into the clip holes, and forms hinge holes for the cover element into which hinge protrusions formed on the decorative cover element are inserted on left and right sides of one end of the upper clip part, and has another end formed to be bent, and wherein the decorative cover element includes hinge protrusions which are formed on left and right sides of the decorative cover element to be inserted into the hinge holes for the cover element of the upper clip part, a patterned part which has patterns carved thereon, and a bending part which is connected to the patterned part and is formed to be bent.

2. The clip-shaped device for preventing tops from becoming untucked according to claim 1, wherein two or more clip members to which the decorative cover elements are coupled are mounted on the tops fixing member.

3. The clip-shaped device for preventing tops from becoming untucked according to claim 1, wherein a part of user's bottoms is inserted between the lower clip part and the upper clip part.

4. The clip-shaped device for preventing tops from becoming untucked according to claim 1, wherein the decorative cover element has a L-shape and a belt is inserted into the decorative cover element.

5. The clip-shaped device for preventing tops from becoming untucked according to claim 1, wherein angle A between the patterned part and the bending part of the decorative cover element is formed in a range of 90 to 100 degrees, and, when a user presses the patterned part after inserting a belt between the patterned part and an upper clip part, the bending part is in contact with an upper side of the lower clip part and is moved upwards, so that a user's bottoms inserted between the upper clip part and the lower clip part is fixed, while at a same time the belt inserted between the upper clip part and the decorative cover element is fixed.

6. The clip-shaped device for preventing tops from becoming untucked according to claim 1, wherein one or more clip-shaped device for preventing tops from becoming untucked is mounted on lower ends of the tops.

7. The clip-shaped device for preventing tops from becoming untucked according to claim 1, wherein the tops fixing part is made of a rubber material.

* * * * *